US006095584A

United States Patent [19]

Walsh et al.

[11] Patent Number: 6,095,584

[45] Date of Patent: Aug. 1, 2000

[54] CONTAINER DISPENSER AND DISPLAY RACK

[76] Inventors: Robert M. Walsh, 812 Glen Garry, Flower Mound, Tex. 75028; Leo C. Squiers, 2500 Mustang #168, Grapevine, Tex. 76051

[21] Appl. No.: 09/169,005

[22] Filed: Oct. 9, 1998

[51] Int. Cl.[7] ..... B65D 71/00

[52] U.S. Cl. ..... 294/166; 211/71.01; 294/87.2; 294/159

[58] Field of Search ..... 294/5.5, 33, 87.1–87.22, 294/87.28, 99.1, 100, 137, 143, 146, 148, 159, 162, 166; 211/14, 71.01, 72–74, 85.18, 89.01, 113; 224/917, 919; 248/300, 309.1, 310, 311.2, 312.1, 313, 316.1, 316.7, 317

[56] References Cited

U.S. PATENT DOCUMENTS

| | | | |
|---|---|---|---|
| 2,331,038 | 10/1943 | Meller | 211/73 |
| 2,487,040 | 11/1949 | Bilodeau | 294/87.1 |
| 2,561,536 | 7/1951 | Rowe | 294/87.1 |
| 2,680,040 | 6/1954 | Gribskov et al. | 294/87.2 |
| 2,703,253 | 3/1955 | Biederman | 294/87.2 |
| 2,737,326 | 3/1956 | Toensmeier | 294/87.2 |
| 2,999,604 | 9/1961 | Chalich | 294/87.1 X |
| 3,301,586 | 1/1967 | Lisiecki | 294/33 |
| 3,487,948 | 1/1970 | Haidegger | 211/71.01 |
| 3,497,118 | 2/1970 | Najjar | 294/166 X |
| 3,527,345 | 9/1970 | Iorio | 294/87.2 X |

*Primary Examiner*—Johnny D. Cherry
*Attorney, Agent, or Firm*—John E. Vandigriff

[57] ABSTRACT

A container dispenser/display rack is made from a single molded or extruded body that has two opposite sides extending up from a base. The sides have openings that separate the sides into a plurality of segments. The segments have ends that are angled inward toward and adjacent to segments on the opposite side. The segments are flexible so that a container may be inserted between the segments ends of the two sides. A container can be inserted into the rack at any point and does not have to be loaded into or removed out of the rack at its ends.

12 Claims, 7 Drawing Sheets

CONTAINER DISPENSER AND DISPLAY RACK

FIELD OF THE INVENTION

The invention relates to contain dispenser racks, and more particularly to a display rack for holding various type containers, including bottles and tubes, which allow the removal of the container from the rack from any location in the rack.

BACKGROUND OF THE INVENTION

Bottle dispensers are common in retail outlets, for example gravity fed bottle dispensing and display racks are used for soda drinks. The bottles are held in a track by the neck or cap of the bottle, and as one bottle is removed, the remaining bottles in the track slide downward to the front of the rack for dispensing. Examples of such gravity fed racks are described in U.S. Pat. Nos. 5,586,665, 5,695,075 and 5,706,958. In these described racks, multiple tracks are mounted side by side so that various soda drinks may be dispensed.

Packing containers may have a track for holding containers. The container is held in the rack by the lid or neck of the container. The containers are removed from the track from the end of the track so that a centrally located container in the track cannot be removed until the containers adjacent to the end of the track are removed. Such a package container is described in U.S. Pat. No. 3,527,345.

SUMMARY OF THE INVENTION

The invention is a container dispenser/display rack that is made from a single molded or extruded body that has two opposite sides extending up from a base. The sides have openings that separate the sides into a plurality of segments. The segments have ends that are angled inward toward and adjacent to segments on the opposite side. The segments are flexible so that a container may be inserted between the segments ends of the two sides. A container can be inserted into the rack at any point and does not have to be loaded into or removed out of the rack at its ends.

Figure 1:
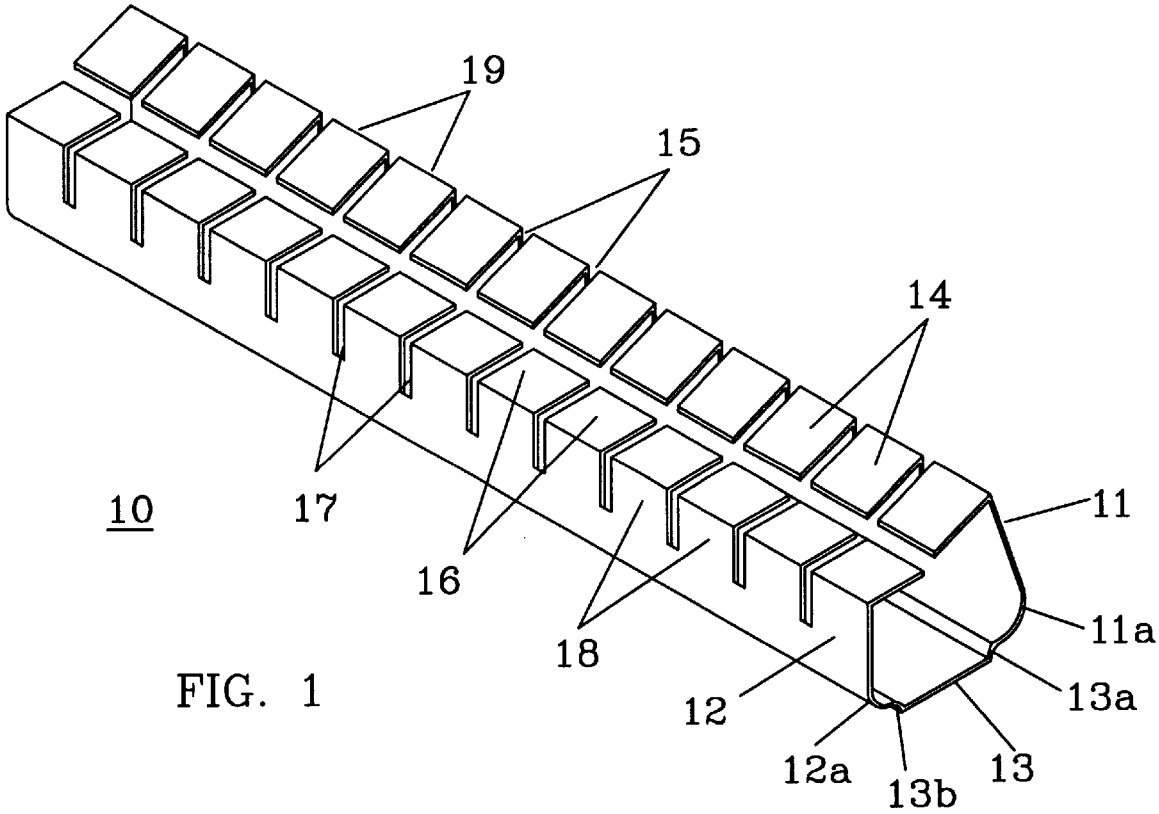
FIG. 1 is an isometric view of the container rack of the present invention.
Figure 4:
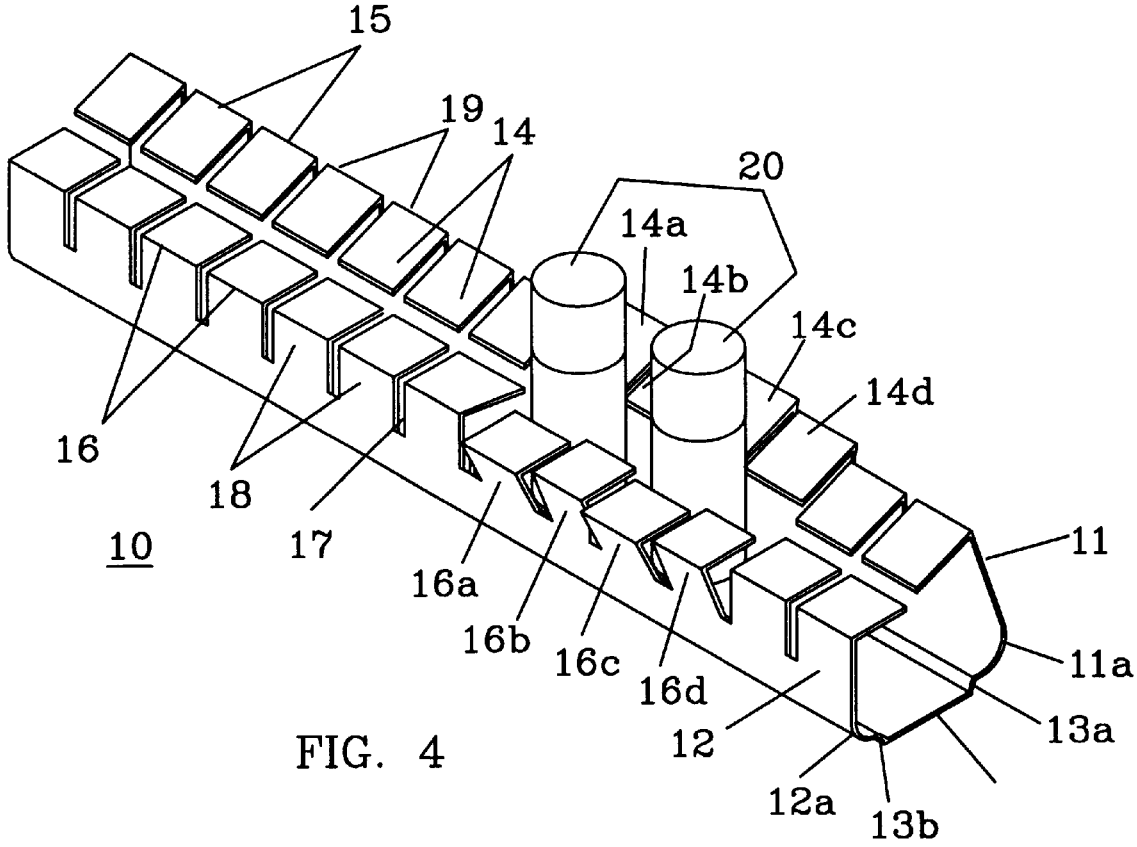
Figure 5:
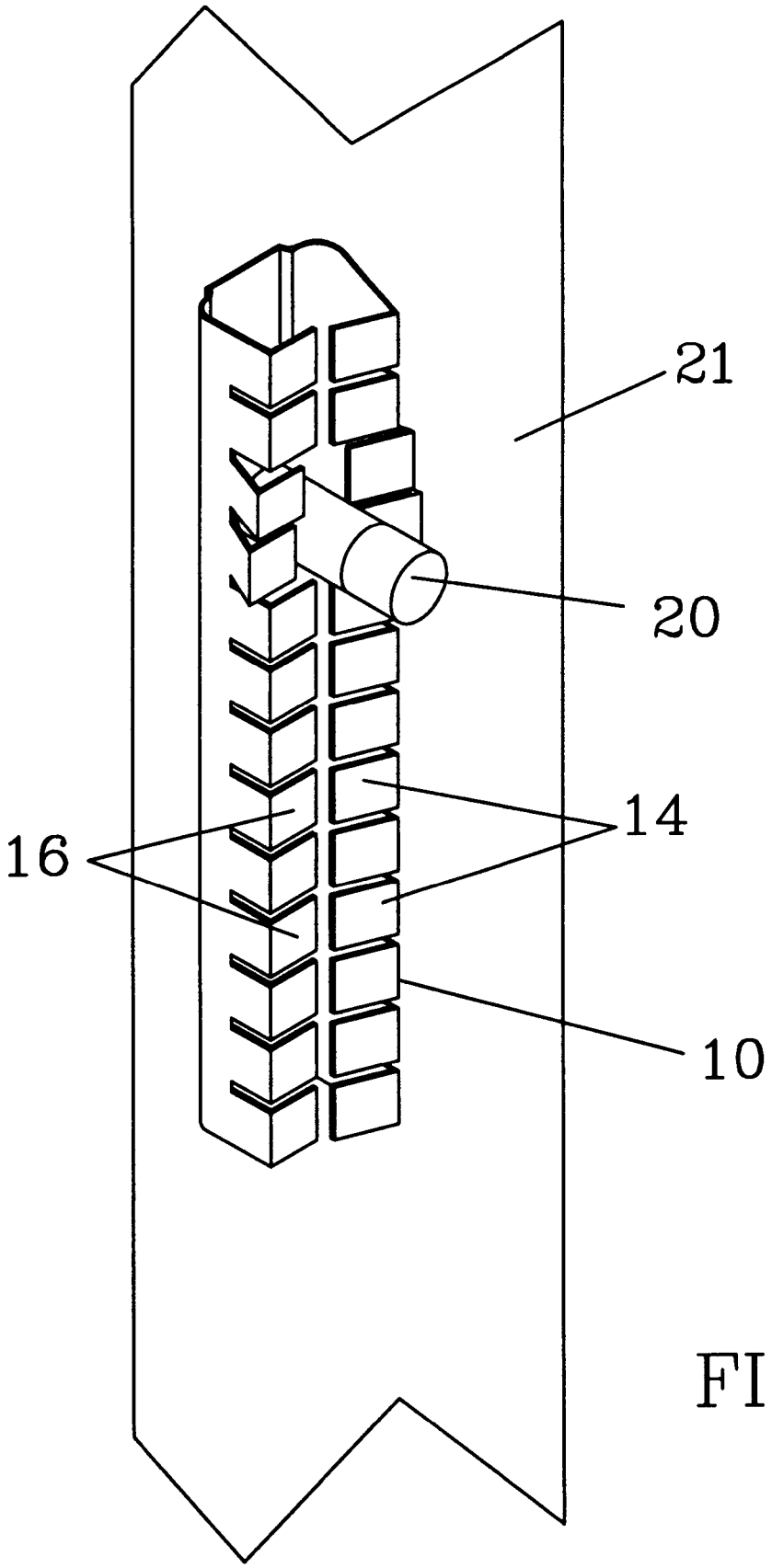
Figure 6:
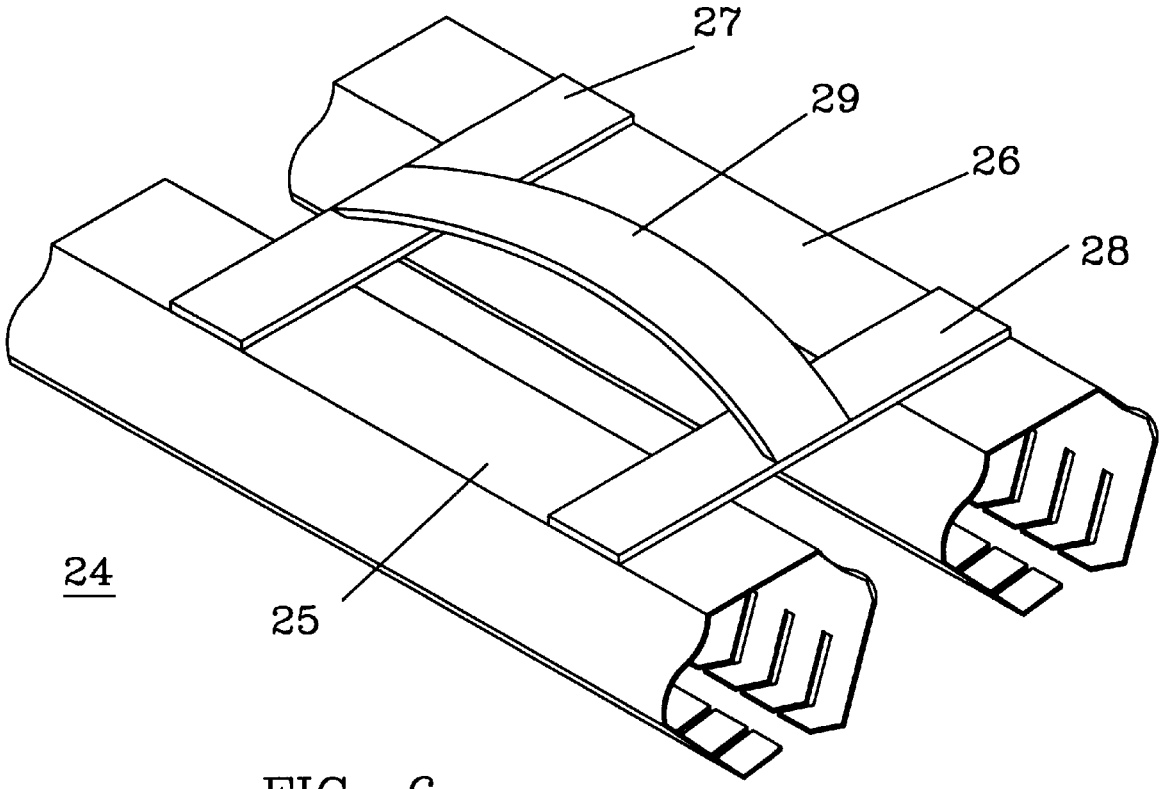
Figure 7:
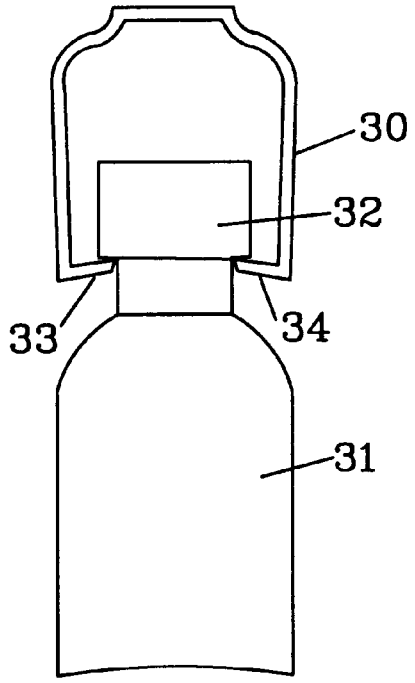

FIGS, 3*a* and 3*b* show the insertion of a container into the container rack;

FIG. 4 shows the container rack of FIG. 1 used for holding and displaying a single tubular package;

FIG. 5 shows the container rack mounted vertically;

FIG. 6 shows a rack assembly of two racks;

FIG. 7 shows the container rack holding a bottle; and

Figure 8:
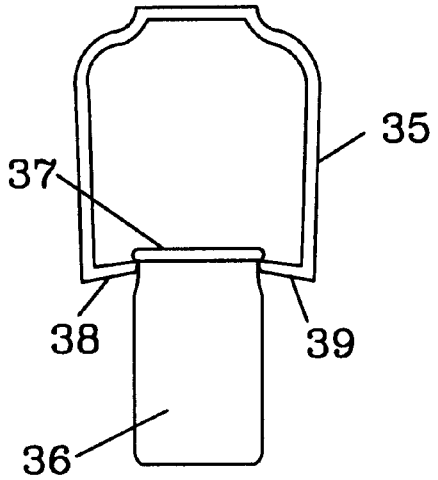

FIG. 8 shows the container rack holding a can or jar.

DESCRIPTION OF A PREFERRED EMBODIMENT

FIG. 1 is an isometric illustration of the dispenser/display rack 10 of the present invention. Rack 10 has a base 13 with two sides 11 and 12. Side 12 is joined to base 13 by curved section 12*a* and base section 13*b*. Side 11 is joined to base 13 by curved section 11*a* and base section 13*a*. Side 12 has vertical openings 17 which divide side 12 into segments 18 which have ends 16 that are formed at an angle to segments 18. Similarly, side 11 has vertical openings 15 that divide side 11 into segments 19. Segments 19 have ends 14 that are formed at an angle to segments 19 and extend inward toward ends 16. The ends 14*a* and 16*a* of segment ends 14 and 16 may be contoured inward to a radius, or concave, as illustrated in FIG. 1, to partially encircle small tubular containers which may be placed in rack 10.

Rack 10 is molded or extruded from a plastic material as one piece. Sides 11 and 12 are cut to form vertical openings 15 and 17, segments 18 and 19 and, ends 14 and 16. Sides 11 and 12 are flexible in that they may be flexed away from each other so that their respective end parts 14 and 16 move away from each other, as shown and described with reference to FIG. 4, allowing an object to be placed between the end parts 14 and 16.

Figure 2:
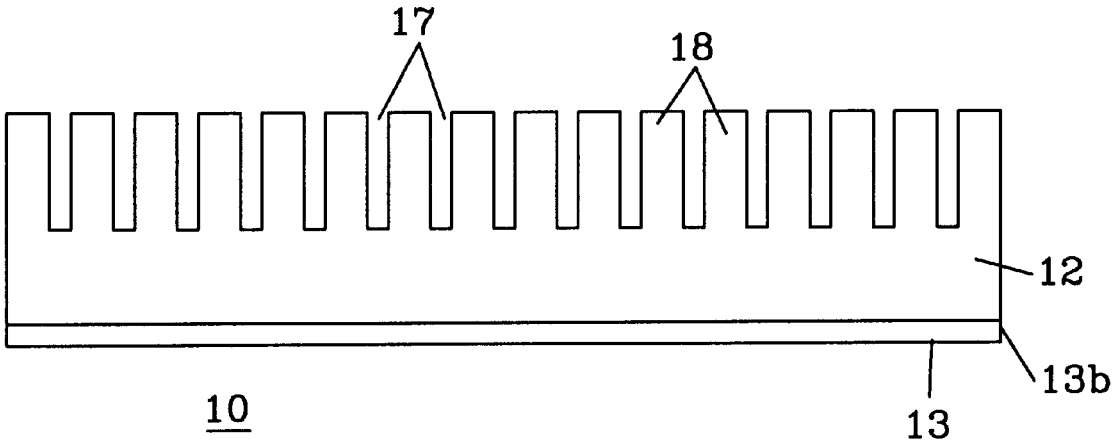
FIG. 2 is a side view of the container rack of FIG. 1.

FIG. 2 is a side view of rack 10 showing side 12 and base 13 side 13*b*. Segments 18 and openings 17 are shown dividing side 12 into segments 18.

Figure 3:
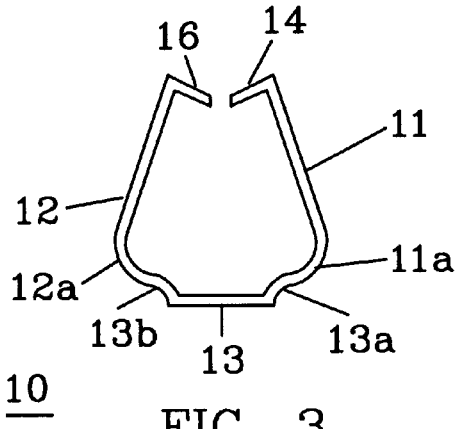
FIG. 3 is an end view of the container rack of FIG. 1.

FIG. 3 is an end view of rack 10. Base 13 is flat so that rack 10 can be placed or mounted on a flat surface. Base section 13*a* and side section 11*a* permit side 11 to be flexed outward from side 12. Base section 13*b* and side section 12*a* permit side 12 to be flexed outward from side 11. A container (not illustrated) may be pressed downward on ends 14 and 16 causing sides 11 and 12 to flex outward which allows the container to move downward between ends 14 and 16, holding the container in place within rack 10.

Figure 3A:
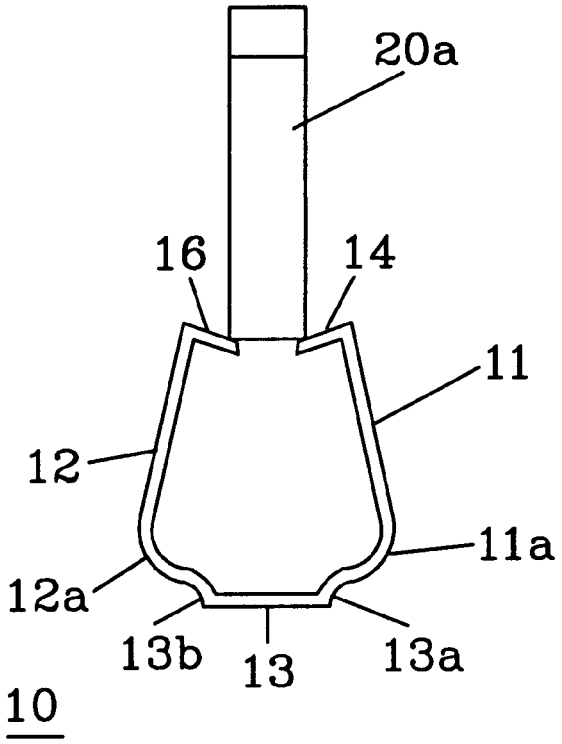
Figure 3B:
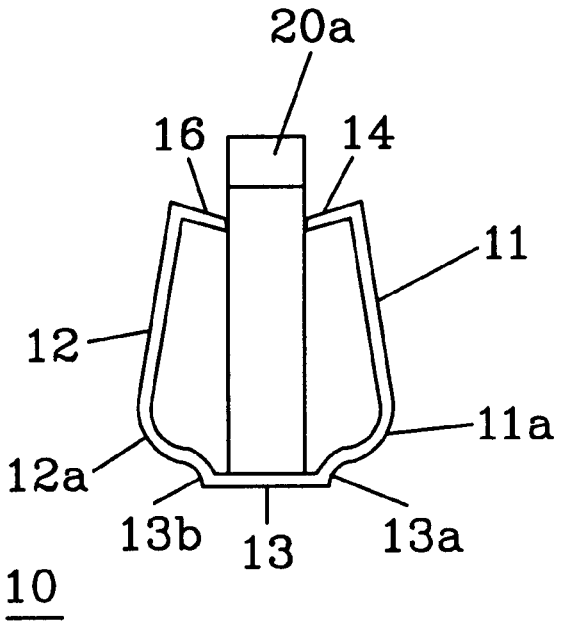

FIGS. 3*a* and 3*b* show the insertion of a container 20*a* into rack 10. As container 20*a* is moved downward, the bottom of container 20*a* moves against ends 14 and 16 spreading them apart (FIG. 3*a*). As container is moved further downward, ends 14 and 16 separate and container 20*a* moves to the bottom of rack 10 (FIG. 3*b*). Since there are a plurality of ends 14 and 16, only the ends 14 and 16 contacted by the bottom of container 20*a* are moved apart. Other containers (not illustrated), even adjacent containers, are not disturbed or released so container 20*a* can be removed without removing any other container.

FIG. 4 shows rack 10 with two containers 20 inserted between ends 14 and 16. Containers 20 are held in position by, for example, ends 14*a*–14*d* on one side and ends 16*a*–16*d* on the other side. Each of containers 20 may be individually removed from rack 10 without moving the other container. A plurality of containers 20 may be mounted in rack 10, filling rack 10 from one end to the other, and each container 20 may be inserted or removed without moving any other container. Containers 20 may be, for example, lipsticks, bottles of finger nail polish, or any other container that can be positioned between ends 14 and 16. Rack 10 may be made of various sizes, having various lengths and widths, to accommodate different size containers.

FIG. 5 shows rack 10 mounted on a vertical surface 21. Several containers 20 may be mounted in rack 10, and will be held in position by ends 14 and 16.

FIG. 6 shows two racks 25 and 26 joined together by straps 27 and 28 to form a carrier 24. A handle 29 is used to hold the carrier. Carrier 24 may be used to carry soda cans or jars of food. For example, FIG. 7 shows the end view of a single rack 30 with a bottle 31 held in place by ends 33 and 34 under cap 32. A plurality of bottles 31 may be placed in carrier 24. Similarly, cans or jars of food, or sodas cans may be carried, stored or displayed in rack 35 as illustrated in FIG. 8. Rack 35 stores a container 36 which is held by ends 38 and 39 of rack 35. Rim 37 of container 36 is supported by ends 38 and 39.

What is claimed:

1. A container dispenser/display rack, comprising:

a unitary structure including an elongated base having a width and length;

two flexible side walls extending upward from the base on opposite sides of the base along the base length;

a plurality of slits in each of said side walls dividing the side walls into a plurality of independent segments movable independent of the other segments, each segment having an independent end angled inward toward and adjacent to a segment on the opposite side wall;

wherein a container may be placed between opposite segment ends by pushing the container downward on the segment ends to flex the segment ends outward to allow the container to move between and be held in place by the segment ends.

2. The container dispenser/display rack according to claim 1, wherein said base is flat to permit said dispenser/display rack to be placed on a flat surface.

3. The container dispenser/display rack according to claim 2, wherein said segments may be flexed individually to allow a container to be inserted and removed from the dispenser/display rack at any position along the rack.

4. The container dispenser/display rack according to claim 1, wherein said side walls are connected to the base by a curved wall extending from the base to the side wall.

5. The container dispenser/display rack according to claim 1 in combination with a second rack, the two racks secured together, and a handle for carrying the combination racks.

6. A container dispenser/display rack, comprising:

a base;

flexible independent segmented side sections divided by a plurality of slits extending upward from said base along two opposite sides of the base; and each side section segments, movable independent of the other segments, having an end part bent inward and adjacent to an end part of a side section on the opposite side of the base.

7. The container dispenser/display rack according to claim 6, wherein said base is flat to permit said dispenser/display rack to be placed on a flat surface.

8. The container dispenser/display rack according to claim 7, wherein said side sections may be flexed individually to allow a container to be inserted and removed from the dispenser/display rack at any position along the rack.

9. The container dispenser/display rack according to claim 6, wherein said side sections are connected to the base by a curved wall extending from the base to the side section.

10. The container dispenser/display rack according to claim 6 in combination with a second rack, the two racks secured together, and a handle for carrying the combination racks.

11. The container dispenser/display rack according to claim 6, wherein said section end parts are contoured.

12. The container dispenser/display rack according to claim 11, wherein said section end parts are contoured to a radius to partially encircle small tubular containers.

* * * * *